United States Patent [19]

Uesugi et al.

[11] Patent Number: 4,909,894

[45] **Date of Patent: * Mar. 20, 1990**

[54] PROCESS FOR PRODUCING SUPPORT FOR LITHOGRAPHIC PRINTING PLATE

[75] Inventors: Akio Uesugi; Kazutaka Oda; Tsutomu Kakei, all of Shizuoka, Japan

[73] Assignee: Fuji Photo Film Co., Ltd., Kanagawa, Japan

[ * ] Notice: The portion of the term of this patent subsequent to Dec. 23, 2004 has been disclaimed.

[21] Appl. No.: 279,227

[22] Filed: Nov. 28, 1988

Related U.S. Application Data

[63] Continuation of Ser. No. 18,366, Feb. 24, 1987, abandoned.

[30] Foreign Application Priority Data

Feb. 24, 1986 [JP] Japan ..... 61-37323

[51] Int. Cl.[4] ..... B44C 1/22; B41C 1/00; B24C 1/08

[52] U.S. Cl. ..... 156/640; 51/321; 51/326; 204/129.35; 156/645; 156/665

[58] Field of Search ..... 156/645, 665, 905, 640; 204/33, 129.1, 129.35, 129.36; 51/321, 323, 326

[56] References Cited

U.S. PATENT DOCUMENTS

| | | | |
|---|---|---|---|
| 4,242,417 | 12/1980 | Huang | 156/665 X |
| 4,324,841 | 4/1982 | Huang | 156/665 X |
| 4,476,006 | 10/1984 | Ohba et al. | 204/33 X |
| 4,524,125 | 6/1985 | Huang | 204/33 X |
| 4,561,944 | 12/1985 | Sasaki et al. | 204/33 |
| 4,613,413 | 9/1986 | Uesugi et al. | 204/33 |
| 4,714,528 | 12/1987 | Takeuchi et al. | 204/33 |

FOREIGN PATENT DOCUMENTS

| | | | |
|---|---|---|---|
| 0131926 | 1/1985 | European Pat. Off. . | |
| 0213371 | 3/1987 | European Pat. Off. . | |
| 2742637 | 4/1979 | Fed. Rep. of Germany | 204/33 |
| 54-46136 | 4/1979 | Japan | 156/665 |
| 54-30554 | 10/1979 | Japan | 51/326 |
| 165625 | 10/1964 | U.S.S.R. | 204/129.35 |
| 625834 | 7/1949 | United Kingdom | 156/665 |

*Primary Examiner*—Kenneth M. Schor

*Attorney, Agent, or Firm*—Sughrue, Mion, Zinn, Macpeak & Seas

[57] ABSTRACT

A process for producing a support for a lithographic printing plate is described, which comprises jetting a high-pressure liquid from at least one nozzle at a high rate, joining the jetted stream with a slurry containing a fine abrasive powder having a specific gravity of not less than 2.5 and having a sharp-angled tip having a radius of not more than 20 μm, said slurry being spouted from at least one spout, directing the resulting mixed stream to strike against a surface of a metal sheet to carry out first graining, and modifying the first roughness thus formed on the metal sheet by brush graining to form a second roughness. Lithographic printing plates produced by using the resulting support are free from stain formation during printing and exhibit satisfactory printing durability.

11 Claims, No Drawings

PROCESS FOR PRODUCING SUPPORT FOR LITHOGRAPHIC PRINTING PLATE

This is a continuation of application Ser. No. 018,366 filed Feb. 24, 1987, and now abandoned.

FIELD OF THE INVENTION

This invention relates to a process for producing a support for lithographic printing plates, and, more particularly, to a process for roughening the surface of an aluminum sheet for use as such a support.

BACKGROUND OF THE INVENTION

In the field of lithographic printing plates, so-called presensitized (PS) plates comprising an aluminum support having provided thereon a light-sensitive layer composed of a light-sensitive composition have been employed. The aluminum support used in the presensitized lithographic printing plates generally has a surface roughened by a process selected from various roughening processes. The roughened surface is then etched with an acid or alkali aqueous solution, anodically oxidized and, if desired, subjected to surface treatment to render it hydrophilic. A light-sensitive layer is coated on the resulting support to obtain a presensitized lithographic printing plate, which is then exposed to light, developed, retouched, gummed, and the like to produce a printing plate.

Typically employed roughening processes include a mechanical roughening process, such as ball graining, wire graining, brush graining, liquid honing, etc.; an electrochemical roughening process called electrolytic graining; a chemical roughening process; and combinations of two or more of these processes. However, each of these techniques has respective disadvantages, as set forth below.

In the case of ball graining, there are problems in that high skills are required for selection of the composition (material) and the size of balls, control of water in carrying out abrasion, determination of abrasion time and evaluation of the finished surface from the nature of a batch system, and productivity is very inferior. In the case of wire graining, the roughness of the resulting surface of the aluminum plate is non-uniform. In the case of brush graining, high roughness is not obtained on the treated surface, and scattering is easily formed on the coarse face due to the wear of the abrasion brush used. Another disadvantage associated with wire graining is that the aluminum surface is scratched by the strong friction with the brush combined with the abrasive to form many sharp projections. These projections are likely to cause problems such as that the light-sensitive layer that should be removed by development remains to cause stains on the printing plate and that scratches are easily formed on the surface by rubbing of the treated surface (roughened surface) on handling of the aluminum plate.

In the case of liquid honing, since a slurry liquid having dispersed therein a fine abrasive powder is sprayed onto an aluminum sheet at a high rate by, e.g., compressed air, the fine abrasive powder easily sticks into the aluminum surface to form projections. Further, this technique cannot attain sufficient roughness because of weak impulsive force of the slurry liquid against the surface of aluminum. Significant wear of a jetting nozzle used for jetting the slurry liquid at a high rate is also a problem.

In the case of electrochemical roughening, achievement of a constant surface roughness requires precise control of electrolysis conditions, and the consumption of electric power is not small. Moreover, disposal of the waste liquor in which aluminum ions are accumulated entails high cost.

Finally the chemical roughening technique not only takes relatively much time for roughening, but also requires great expense for disposal of the waste liquor as in the case of the electrochemical technique, and is, therefore, not completely suitable for mass production.

In order to attempt to overcome some of the above-described disadvantages associated with each graining process, combined roughening processes have been described. One combination that has been described is that of brush graining or wire graining and electrolytic graining as disclosed in U.S. Pat. No. 2,344,510 and Japanese Patent Application (OPI) Nos. 123204/78, 145701/78, and 63902/79 (the term "OPI" as used herein means "unexamined published application"), and another is a combination of liquid honing and electrolytic graining as disclosed in Japanese Patent Application (OPI) No. 19593/85.

According to such combined processes, however, when brush graining is adopted as a first step, i.e., a mechanical graining step, stains are apt to be formed in the nonimage areas during printing; and when wire graining is adopted as the first step, the resulting printing plate has poor printing durability.

A system in which an abrasive slurry liquid is accelerated by a high-pressure liquid is suitable for mass production and excellent in stain resistance, but it is still unsatisfactory in providing sufficient printing durability, thus leaving room for further improvements to meet the market demand for further improved properties.

While a roughening process comprising forming a first roughness by liquid honing and then modifying the first roughness by brush graining has been proposed in U.S. patent application Ser. No. 886,625 now U.S. Pat. No. 4,714,528 (corresponding to Japanese Patent Application (OPI) No. 27192/87), a further improvement in printing durability has been strongly desired in the market.

SUMMARY OF THE INVENTION

Accordingly, one object of this invention is to provide a process for producing a support for lithographic printing plates which are free from stain formation during printing and exhibit good printing durability.

Another object of this invention is to provide a process for producing a support for lithographic printing plates, which can stably form a uniform surface roughness and is suitable for mass production.

The inventors have carried out extensive investigations, including with respect to specific gravity of abrasive materials and to differences in performances of lithographic printing plates depending on the mechanical roughening process employed in the above-mentioned combined roughening process.

As a result, it has now been found that the above objects can be accomplished by a process for producing a support for a lithographic printing plate which comprises jetting a high-pressure liquid from at least one nozzle at a high rate, joining the jetted stream with a slurry containing a fine abrasive powder having a specific gravity of not less than 2.5 and having sharp-angled tips having a radius of not more than 20 μm, said slurry being spouted from at least one spout, directing the resulting mixed stream to strike against a surface of a metal sheet to carry out first graining, and modifying the first roughness thus formed on the metal sheet by brush graining to form second roughness.

In a preferred embodiment according to this invention, the above-described roughening process further includes at least one of chemical etching and electrochemical graining.

DETAILED DESCRIPTION OF THE INVENTION

A metal web for the support which can be used in the present invention preferably includes an aluminum sheet. The aluminum sheet to be used includes not only pure aluminum, but also aluminum alloys which is composed of aluminum as a main component and trace amounts of silicon, copper, iron, manganese, magnesium, chromium, zinc, lead, bismuth, nickel, etc. In any case, the aluminum preferably has a purity of 99.0% by weight or more.

While the following description refers particularly to the roughening of an aluminum sheet, it is understood that the present invention be applicable not only an aluminum web, but also other metal webs, e.g., zinc, iron, etc.

The aluminum sheet as a support of lithographic printing plates generally has a rectangular form in connection to a printing machine. However, the sheet before being cut into a rectangle, particularly in mass production, has a web form. Whether the sheet is in a web form or a rectangular form is appropriately selected depending on the particular application. The thickness of the aluminum sheet is properly selected from the range of from 0.1 to 0.5 mm according to tensile strength, resistance, elongation, bending strength, and the like, required for the particular application of the lithographic printing plate to a printing machine.

In the liquid honing step for roughening the surface of the aluminum sheet, an apparatus for carrying out the liquid honing comprises at least one nozzle connected to a feeder of the high-pressure liquid and a spout connected to a feeder of the abrasive slurry, in which the nozzle(s) and the spout are arranged so that the slurry spouted from the latter is joined with the stream of the high-pressure liquid jetted from the former. In case of using plural nozzles for jetting the high-pressure liquid, they may be provided around the spout for the abrasive slurry.

The feeder for the high-pressure liquid can exist in various embodiments, including, for example, a container containing a liquid kept at a high liquid pressure, and a system composed of a container containing a liquid at atmospheric pressure and a pressure spouting pump connected to the container. In any embodiment, it is necessary that the liquid be jetted from the nozzle(s) at a flow rate of from 30 to 140 m/sec. The liquid pressure for achieving such a flow rate is from 5 to 100 $Kg/cm^2$.

If desired, the high-pressure liquid may contain an acid or an alkali.

On the other hand, the feeder for the abrasive slurry comprises a container for the slurry, and, desirably, a means for stirring the slurry so as to prevent precipitation of solids. The means for stirring to prevent precipitation of solids may be a propeller stirrer inserted in the container or may be a system of circulating the slurry. By constantly moving the slurry, the solids in the slurry can be prevented from precipitating.

The container for the slurry is connected to the spout via a tube, e.g., a pressure-resisting hose, and a pump for spouting the slurry is provided in the middle of the connecting tube. The feeder for the abrasive slurry having the above-described construction feeds the slurry in a stirred state to the spout through the connecting tube by means of the pump, to thereby spout the abrasive slurry from the spout. The spouting rate of the slurry generally ranges from 2 to 25 m/sec.

The slurry comprises water and a fine powder of an abrasive. The fine powder abrasive is used at a concentration of from about 5 to 80% by weight, and preferably from about 30 to 50% by weight. If desired, the slurry may contain an acid or an alkali.

The abrasive which can be used in the present invention should have a specific gravity of not less than 2.5 and have sharp-angled tips having a radius of not more than 20 μm. It is preferable that the abrasive particles retain such a sharp-angled form even after striking the aluminum sheet. It is also preferable that the abrasive has a silicon content of 8% by weight or more. The particle size of the abrasive usually ranges from about #20 to #4000, as determined according to JIS R6001.

The terminology "sharp-angled tips having a radius of not more than 20 μm" as used herein for the abrasive grains means that typical sharp-angled tips of individual abrasive grains have an average radius of curvature of not more than 20 μm.

The stream of the slurry is accelerated by the stream of the high-pressure liquid to strike against the surface of the aluminum sheet. The angle of the striking stream against the aluminum sheet suitably ranges from 15° to 165°.

The aluminum sheet having a first surface roughness as obtained by the above-described liquid honing is then subjected to brush graining to form a second roughness.

In order to obtain a uniform surface roughness, the brush graining is preferably carried out by the process described in Japanese Patent Publication No. 40047/75.

A brush roll which can be used in the brush graining comprises a roll having a rubber or metal surface as a backing into which bristles of a uniform length, such as nylon, polypropylene, animal bristles, steel wire, etc., are implanted with a uniform distribution. The brush bristles preferably have a diameter of from 0.1 mm to 1.5 mm and a length of from 10 mm to 150 mm after filling.

A rotational speed of the brush roll is selected arbitrarily from the range of from 200 rpm to 2000 rpm. The backing roll to be used should be such as to prevent curling.

An abrasive slurry is directed onto the aluminum sheet while moving by means of a spray, etc. before passing under a brush roll.

In the brush graining, the brush roll is pressed onto the aluminum sheet so that surface roughening may be carried out under a constant pressure.

The abrasive slurry which can be used in the brush graining is an aqueous dispersion of a commonly employed abrasive material, such as emery, silica sand, alumina powders, carborundum, pumice, zirconia powders, etc. A preferred concentration of these abrasives ranges from 10 to 70% by weight.

The resulting aluminum sheet having the first roughness combined with the second roughness thus formed preferably has a center-line average roughness (Ra) of from about 0.3 to about 1.2 μm, and more preferably from 0.35 to 0.8 μm. This aluminum sheet has satisfactory water retention properties owing to sharp-cut and deep bottoms of the roughness. The sharpness and depth of the roughness are attributed to the sharp-angled tips (20 μm or less in radius) and the specific gravity (2.5 or more) of the abrasive used in the liquid honing, respectively. The brush graining subsequent to the liquid honing serves to remove unfavorable sharp projections formed during the liquid honing to thereby provide a support having excellent stain resistance and printing durability.

While the aluminum sheet as produced by the abovedescribed combined mechanical graining may be used as a support for lithographic printing plates, it is preferable that the mechanically grained aluminum sheet is further subjected to at least one of electrochemical graining and chemical etching, more preferably to both of them. In particular, when it is desired to uniformly conduct electrochemical graining as hereinafter described, the electrochemical graining is preferably preceded by chemical etching. The chemical etching is usually carried out by using an alkali aqueous solution. The alkali agent to be used preferably includes sodium hydroxide, potassium hydroxide, sodium metasilicate, sodium carbonate, sodium aluminate, sodium gluconate, etc. A suitable concentration of the alkali agent is from 1 to 50% by weight. In addition to alkalis, solutions capable of corroding aluminum, such as aqueous solutions of acids (e.g., hydrofluoric acid, phosphoric acid, sulfuric acid, etc.) may also be employed. The etching is usually effected at a temperature of from room temperature to 90° C., for a period of from 5 seconds to 5 minutes, until from 0.1 to 10 g/m$^2$ of aluminum is etched. minutes, until from 0.1 to 10 g/m Since the aluminum sheet having been alkali-etched contains unetched, alkali-insoluble substances (smut) on its surface, it is typically subjected to desmutting with an acidic solution, e.g., an aqueous solution of nitric acid, sulfuric acid, phosphoric acid, etc.

Subsequently, the surface of the aluminum sheet is electrochemically roughened. The electrochemical graining is usually carried out by electrolysis in an electrolyte comprising from 0.1 to 10% by weight, and preferably from 0.3 to 3% by weight, of a hydrochloric acid or nitric acid solution, or a mixture thereof, using a direct or alternating current power source, to thereby form a second roughness on the aluminum sheet in proportion to the amount of electricity applied. The second roughness generally has a pit depth of from 0.1 to 1 μm, and preferably from 0.1 to 0.8 μm, and generally a pit diameter of from 0.1 to 5 μm, and preferably from 0.1 to 3 μm.

Formation of pits having the above-recited pit diameter is advantageously effected by using a special alternating current having specific waves as described in Japanese Patent Publication Nos. 19280/81 and 19191/80 (corresponding to U.S. Pat. No. 4,087,341) by which the second roughness can be formed economically and uniformly through control of the electrolytic waves. Further, the electrolyte to be used may contain amines, gluconic acid, boric acid, phosphoric acid, hydrofluoric acid, etc., as described in U.S. Pat. Nos. 3,963,564 and 3,980,539.

It is preferable that the aluminum sheet having the second roughness thus formed is then treated with an acid or alkali solution. Examples of useful acids include sulfuric acid as described in Japanese Patent Publication No. 11316/81, as well as a mixture of phosphoric acid and chromic acid. On the other hand, the alkali treatment comprises lightly etching the surface with an alkaline solution, such as a sodium hydroxide aqueous solution, as described in Japanese Patent Publication No. 28123/73, to remove smut that may be stuck to the surface. In this case, as the alkali-insoluble matter remains on the etched surface, the aluminum sheet should be subjected to desmutting with an acid solution, e.g., an aqueous solution of sulfuric acid, phosphoric acid, chromic acid, etc.

For the purpose of improving stability of a diazo compound present in the light-sensitive layer, adhesion between the support and the light-sensitive layer, or printing durability of the resulting printing plate, the aluminum sheet having its surface roughened by the combination of liquid honing and brush graining according to the present invention may be subjected to anodic oxidation to form an anodic oxidation film on its surface, or an intermediate layer may be formed on the aluminum surface. The anodic oxidation treatment or formation of an intermediate layer is also applicable to the support having been further subjected to electrochemical graining. The intermediate layer herein referred to includes an alkali metal silicate layer which can be provided by, for example, dipping in a sodium silicate solution as disclosed in U.S. Pat. Nos. 2,714,066 and 3,181,461, and a hydrophilic subbing layer comprising a hydrophilic high polymer, e.g., carboxymethyl cellulose, polyvinyl alcohol, etc.

The anodic oxidation is preferably preceded by alkali etching followed by desmutting. The electrolyte to be used for anodic oxidation includes sulfuric acid, phosphoric acid, chromic acid, oxalic acid, benzenesulfonic acid, etc. An anodic oxidation film is preferably formed in a thickness of from 0.1 to 10 g/m$^2$, and more preferably from 0.3 to 5 g/m$^2$. The conditions for anodic oxidation are not particularly limited, varying depending on the type of the electrolytic solution used, but it is generally preferred to employ the conditions of an electrolyte concentration in the electrolytic solution of from 1 to 80% by weight, a liquid temperature of from 5° to 70° C., a current density of from 0.5 to 60 A.dm$^2$, an electric voltage of from 1 to 100 V, and an electrolysis time of from 10 seconds to 5 minutes.

The thus obtained aluminum sheet having an anodic oxidation film is excellent in stability and hydrophilic properties, and is, therefore, useful as a support on which a light-sensitive composition may be coated directly. If desired, the anodically oxidized aluminum sheet can further be subjected to additional surface treatments. For example, the above-described intermediate layer, such as a silicate layer and a subbing layer, may be formed thereon. The subbing layer is preferably coated to a thickness of from 5 to 150 mg/m$^2$.

Onto the aluminum support according to the present invention, a conventionally known light-sensitive layer is formed to obtain a presensitized lithographic printing plate precursor, which is then imagewise exposed to light and developed to produce a lithographic printing plate having excellent performance properties.

The present invention is illustrated below in greater detail with reference to examples, but it should be understood that the present invention is not limited thereto. In these examples, all percentages are by weight unless otherwise indicated.

EXAMPLE 1

A 40 vol % aqueous slurry of alumina-containing abrasive particles having a specific gravity of 3.98 and sharp-angled tips of 20 μm or smaller in radius ("Morandum" trademark for $Al_2O_3$ made by Showa Denko K.K.) was spouted to join with a water stream jetted from a plurality of nozzles fixed at 35-mm intervals at a pressure of 25 Kg/cm$^2$, and the mixed stream was directed to strike against a continuously moving surface of a JIS 1050 aluminum web (width: 300 mm) at an angle of 45° to roughen the aluminum surface.

The rough surface of the aluminum sheet was then subjected to brush graining using three brush rolls each comprising a metal roll having a diameter of 330 mm and a width of 400 mm filled with nylon bristles having a diameter of 0.48 mm to a height of 46 mm. The brush rolls were designed to be rotated by motor driving and to ascend or descend by a lift. The first and the last brush rolls were rotated in the same direction of the moving aluminum sheet, with the middle one being rotated in the reverse direction. The brush rolls were rotated at a speed of 350 rpm while being pressed against the aluminum sheet under a pressure such that the motor load became 25 KW.

The resulting aluminum support had a center-line average roughness of 0.6 μm as determined by the method of JIS B0601 (1982). The support was then treated with No. 3 sodium silicate ($SiO_2$:$Na_2O$=3:1). This support was designated as Sample (A).

COMPARATIVE EXAMPLE 1

The same procedure of Example 1 was repeated except for using abrasive particles having round tips by striking against an aluminum sheet 700 times. The resulting aluminum sheet had a center-line average roughness of 0.56 μm. The support was then treated with No. 3 sodium silicate. This support was designated as Sample (B).

COMPARATIVE EXAMPLE 2

The same procedure of Example 1 was repeated except for using a 40 vol % aqueous slurry containing, as an abrasive, a volcanic ash comprising amorphous silicon dioxide particles ($Al_2O_3$ and $SiO_2$) and having a particle size of #120, a specific gravity of 2.20, and sharp-angled tips of 20 μm or smaller in radius.

The resulting aluminum support had a center-line average roughness of 0.55 μm. The support was then treated with No. 3 sodium silicate. This support was designated as Sample (C).

Each of Samples (A), (B), and (C) was coated with a light-sensitive coating composition having the following formulation to a coverage of 2.5 g,/m$^2$ in order to form a light-sensitive layer.

Formulation of Light-Sensitive Composition:

| | |
|---|---|
| Ester compound of naphthoquinone-1,2-diazido-5-sulfonyl chloride, pyrogallol, and an acetone resin (the same as described in U.S. Pat. No. 3,635,709) | 0.75 g |
| Cresol novolak resin | 2.00 g |
| Oil Blue #603 (oil-soluble dye produced by Orient Kagaku K.K) | 0.04 g |
| Ethylene dichloride | 16 g |
| 2-Methoxyethyl acetate | 12 g |

Each of the thus prepared presensitized printing plate precursors was brought into intimate contact with a transparent positive pattern and exposed to light emitted from a 3 KW metal halide lamp from a distance of 1 m for 50 seconds through the pattern in a vacuum printer. The exposed plate was then developed with a 5.26% aqueous solution of sodium silicate ($SiO_2$/$Na_2O$ molar ratio: 1.74) (pH=12.7).

The resulting lithographic printing plate was mounted on a printer "Sprint 25" manufactured by Komori Insatsu K.K., and printing was carried out in a conventional manner. The results obtained are shown below.

In Table 1 below and subsequent Tables 2 and 3, the printing durability was expressed in terms of numbers of prints which could be printed using a printing plate with good adhesion of a printing ink to the image area.

Also, the stain resistance was determined by visually observing strains in the non image area in the resulting prints by panel test.

TABLE 1

| | Example 1 | Comparative Example 1 | Comparative Example 2 |
|---|---|---|---|
| Support | (A) | (B) | (C) |
| Abrasive: | | | |
| Specific Gravity | 3.98 | 3.98 | 2.20 |
| Form | sharp-angled tips | round tips | sharp-angled tips |
| Radius of Tips | <20 μm | >20 μm | <20 μm |
| Shape of Roughness | sharp-cut and deep | mild-cut and shallow | sharp-cut and deep |
| Result of Printing: | | | |
| Printing Durability | 50,000 prints | 15,000 prints | 45,000 prints |
| Appearance (gloss*) | 3.2 | 5.0 | 4.0 |
| Stain Resistance** | good | poor | good to poor |

Note:
*Measured by a glossmeter, "VG-10" manufactured by Nippon Denshoku K.K., at a reclection angle of 60°.
**When the stains of prints were minimal and presented no practicl problem, the printing plate was graded "good". When the stains were formed to such an extent that it became a problem for practical use, the printing plate was graded "poor".

EXAMPLE 2 AND COMPARATIVE EXAMPLES 3 AND 4

Mechanical graining of aluminum sheets was carried out in the same manner as described in Example 1, Comparative Example 1, and Comparative Example 2, respectively. After washing with water, each of the aluminum sheets was soaked in a 10% sodium hydroxide aqueous solution heated at 70° C. to etch 6 g/m$^2$ of aluminum. After washing with water, the aluminum sheet was dipped in a 30% nitric acid aqueous solution for 1 minute to neutralize, followed by thoroughly washing with water.

The aluminum sheet was then anodically oxidized in a 20% sulfuric acid aqueous solution using a direct current to form 1.5 g/m$^2$ of an anodic oxidation film. After washing with water, the aluminum sheet was soaked in a 2% sodium silicate aqueous solution at 70° C. for 1 minute, washed with water, and dried.

Each of the resulting supports, Samples (D), (E) and (F), respectively, was coated with a light sensitive coating composition having the following formulation to a dry coverage of 2.0 g/m$^2$.

Formulation of Light-Sensitive Composition:

| | |
|---|---|
| N-(4-Hydroxyphenyl)methacrylamide/2-hydroxyethyl methacrylate/acrolonitrile/methyl methacrylate/methacrylic acid copolymer (15:10:30:38:7 by mol; average molecular weight: 60,000) | 5.0 g |
| Hexafluorophosphate of a condensate between 4-diazodiphenylamine and formaldehyde | 0.5 g |
| Phosphorous acid | 0.05 g |
| Victoria Pure Blue BOH (a dye manufactured by Hodogaya Chemical Co., Ltd.) | 0.1 g |
| 2-Methoxyethanol | 100 g |

The resulting printing plate precursor was exposed to light emitted from a 3 KW metal halide lamp from a distance of 1 m for 50 seconds through a negative transparent pattern in a vacuum printer, developed with a developer having the following formulation, and gummed up with a gum arabic aqueous solution to obtain a lithographic printing plate.

Formulation of Developer:

| | |
|---|---|
| Sodium sulfite | 5 g |
| Benzyl alcohol | 30 g |
| Sodium carbonate | 5 g |
| Sodium isopropylnaphthalenesulfonate | 12 g |
| Pure water | 1,000 ml |

Each of the thus prepared lithographic printing plate was used for printing using the printer "Sprint 25" in a conventional manner. The results obtained are shown in Table 2 below.

TABLE 2

| | Example 2 | Comparative Example 3 | Comparative Example 4 |
|---|---|---|---|
| Support | D | E | F |
| Printing Durability | 100,000 | 70,000 | 90,000 |
| Stain Resistance | good | poor | good to poor |

The results of Table 2 clearly demonstrate the remarkable improvement on printing durability which is obtained when the mechanical graining is followed by chemical etching and is further followed by electrochemical etching.

EXAMPLE 3 AND COMPARATIVE EXAMPLES 5 AND 6

Each of Samples (A) to (C), after being washed with water, was etched with a 30% sodium hydroxide aqueous solution at 60° C. until 6 g/m$^2$ of aluminum was etched. After washing with water, the aluminum sheet was soaked in a 20% nitric acid aqueous solution to remove any insoluble residue (smut) on the surface, followed by washing with water.

The aluminum sheet was then subjected to electrochemical graining in a 0.7% nitric acid aqueous solution using an alternating wave current as described in U.S. Pat. No. 4,087,341 (corresponding to Japanese Patent Publication No. 19191/80) under electrolysis conditions of $V_A$=12.7 V, $V_C$=9.1 V, and an anodic electric amount of 160 coulomb/dm$^2$. After removing the smut on the surface, an anodic oxidation film having a thickness of 2 g/m$^2$ was formed in a 20% sulfuric acid aqueous solution.

Each of the resulting support (Samples (G) to (I), respectively) was coated with the same light-sensitive coating composition as used in Example 1 to a dry coverage of 2.5 g/m$^2$, exposed to light, and developed to obtain a lithographic printing plate. When the resulting printing plate was used for printing using the printer "Sprint 25" in a usual manner, the results as shown in Table 3 were obtained. As compared with Example 2, Comparative Examples 3 and 4, the results of Table 3 show that printing durability can be improved when the mechanical graining is followed by chemical etching and is further followed by electrochemical graining.

TABLE 3

| | Example 3 | Comparative Example 5 | Comparative Example 6 |
|---|---|---|---|
| Support | G | H | I |
| Printing Durability | 120,000 | 80,000 | 100,000 |
| Stain Resistance | good | poor | good to poor |

As described above, in the mechanical graining of an aluminum sheet, in which a high-pressure liquid is jetted from a nozzle(s) at a high rate to join with an abrasive slurry spouted from a spout, and a resulting mixed stream is directed to strike against an aluminum surface, use of abrasive particles having such a sharp-angled tip as having a radius of not more than 20 μm results in a surface roughness having a sharp-cut bottom, and use of abrasive particles having a specific gravity of not less than 2.5 makes a deep-cut surface roughness. Furthermore, subsequent brush graining is effective to remove the sharp projections on the surface formed by the above-described liquid honing. Thus, a roughened surface of a support for lithographic printing plates having excellent printing durability and stain resistance can be obtained. Printing durability can further be enhanced markedly by performing chemical etching followed by electrochemical graining in combination with the aforesaid mechanical graining.

While the invention has been described in detail and with reference to specific embodiments thereof, it will be apparent to on skilled in the art that various changes and modifications can be made therein without departing from the spirit and scope thereof.

What is claimed is:

1. A process for producing a support for a lithographic printing plate, which comprises jetting a high-pressure liquid from at least one nozzle at a high rate, joining the jetted stream with a slurry containing a fine abrasive powder having a specific gravity of not less than 2.5 and having a sharp-angled tip having a radius of not more than 20 μm, said slurry being spouted from at least one spout, directing the resulting mixed stream to strike against a surface of a metal sheet to carry out first graining, and modifying the first roughness thus formed on the metal sheet by brush graining to form a second roughness.

2. A process as in claim 1, wherein said process further includes at least one of chemical etching and electrochemical graining of the metal sheet after the brush graining.

3. A process as in claim 1, wherein the high-pressure liquid is jetted from at least one nozzle at a flow rate of from 30 to 140 m/sec at a pressure of from 5 to 100 Kg/cm$^2$, and the slurry is spouted from a spout at a flow rate of from 2 to 25 m/sec.

4. A process as in claim 3, wherein the angle of the striking stream against the metal sheet is from 15° to 165°.

5. A process as in claim 1, wherein the abrasive powder retains its sharp-angled form after striking the metal sheet.

6. A process as in claim 1, wherein the abrasive powder has a silicon content of 8% by weight or more.

7. A process as in claim 1, wherein the metal surface having the first and second roughness has an average centerline roughness of from about 0.3 to about 1.2 μm.

8. A process as in claim 1, wherein the metal surface having the first and second roughness has an average centerline roughness of from 0.35 to 0.8 μm.

9. A process as in claim 1, wherein the angle of the striking stream against the metal sheet is from 15° to 165°.

10. A process as in claim 1, wherein said metal sheet is an aluminum sheet or an aluminum alloy sheet.

11. A process as in claim 1, further comprising anodic oxidation following brush graining.

* * * * *